US005349838A

United States Patent [19]

Latour

[11] Patent Number: 5,349,838

[45] Date of Patent: Sep. 27, 1994

[54] BENDING HEAD WITH MULTIPLE TOOLS FOR A MACHINE FOR BENDING METAL WIRES

[75] Inventor: Yves Latour, Haraucourt, France

[73] Assignee: Latour & Fils S.A., France

[21] Appl. No.: 949,650

[22] PCT Filed: Jun. 5, 1992

[86] PCT No.: PCT/FR92/00511

§ 371 Date: Dec. 4, 1992

§ 102(e) Date: Dec. 4, 1992

[87] PCT Pub. No.: WO92/21455

PCT Pub. Date: Dec. 10, 1992

[30] Foreign Application Priority Data

Jun. 6, 1991 [FR] France ..... 91 07101

[51] Int. Cl.[5] ..... B21D 7/024

[52] U.S. Cl. ..... 72/219; 72/387

[58] Field of Search ..... 72/307, 217–219, 72/157, 149, 442, 387

[56] References Cited

U.S. PATENT DOCUMENTS

| | | | |
|---|---|---|---|
| 3,299,681 | 1/1967 | Hautau | 72/157 |
| 4,571,974 | 2/1986 | Pollhammer | 72/217 |
| 4,718,265 | 1/1988 | Post | 72/217 |

FOREIGN PATENT DOCUMENTS

| | | |
|---|---|---|
| 0079587 | 5/1983 | European Pat. Off. . |
| 0108695 | 5/1984 | European Pat. Off. . |
| 0123231 | 10/1984 | European Pat. Off. . |
| 0904295 | 8/1962 | United Kingdom . |
| 2172229 | 9/1986 | United Kingdom . |

*Primary Examiner*—Daniel C. Crane

*Attorney, Agent, or Firm*—Lerner, David, Littenberg, Krumholz & Mentlik

[57] ABSTRACT

Apparatus for bending metal wires is disclosed including a cylindrical housing enclosing a rotatable cage which is mounted on a longitudinally extending arm pivotable about the axis of the wire itself, the rotatable cage being rotatable about a cage axis which is perpendicular to the axis of the wire. The apparatus includes a motor for rotating the rotatable cage about its axis, a plurality of tool carrying shafts which are mounted within the rotatable cage for slidable movement along their longitudinal axes between a rest position within the cage and an extended position in which the tool carried by the tool carrying shaft projects from the cage into the path of the metal wire, a jackscrew mounted on the housing for selectively actuating one of the tool carrying members and moving it from its rest position to its extended position, and a geared motor for rotating the selected one of the tool carrying shafts about its longitudinal axis.

9 Claims, 1 Drawing Sheet

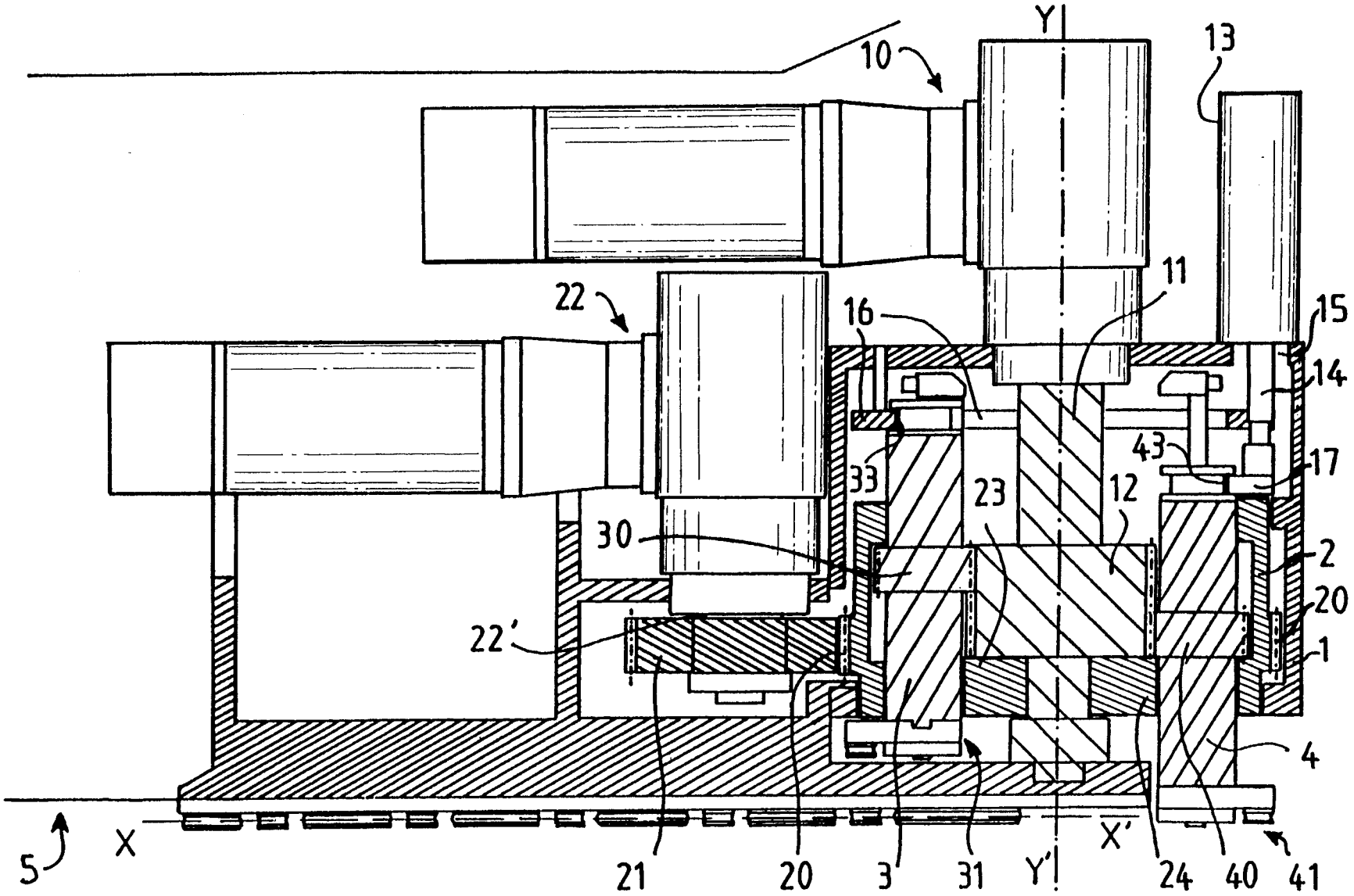
15
14
17
2
20
1
4
41
40
24
13
11
43
12
X'
Y
Y'
23
31
10
16
33
3
20
30
21
22
22'
X
5

BENDING HEAD WITH MULTIPLE TOOLS FOR A MACHINE FOR BENDING METAL WIRES

FIELD OF THE INVENTION

The present invention relates to a bending head with multiple tools for a machine for bending metal wires.

BACKGROUND OF THE INVENTION

Two major classes of machines are presently in existence for use in the bending of metal wires; i.e., (2) those machines which are used in large-scale production, and which include bending tools which are placed in a position which corresponds to the shape which is to be imparted to the metal wire, and (2) those machines which are used in small-scale production, which, unlike the previously mentioned machines, require only a small amount of tooling in order to change from one shape to another.

The machines in category (2) above, which are used to bend wire, are virtually all designed in the same way. In this method, the wire is taken from a spool or coil, passes through a straightening device, and is then processed by a handling system which delivers the desired length of wire to the bending tool, which generally consists of a finger and a bending unit, between which the metal wire passes, with the pivoting of the tool resulting in the bending of the wire.

The disadvantage of these machines is that they generally consist of only a single tool, but in order to achieve bends with different radii of curvature, it is necessary to combine the work of that tool with the forward motion of the wire, which in some cases renders it impossible to obtain an accurate result.

The present invention makes it possible to remedy these disadvantages by providing a bending head having multiple tools, whose design is simple, and which can be readily affixed to machines for bending metal wires.

SUMMARY OF THE INVENTION

In accordance with the present invention, these and other objects have now been accomplished by the discovery of apparatus for bending metal wires passing along a predetermined axis including a longitudinally extending arm pivotable about that predetermined axis, the apparatus comprising a bending head affixed to the longitudinally extending arm, the bending head including a rotatable cage mounted on the arm and rotatable about a cage axis which is perpendicular to the predetermined axis, motor means for rotating the rotatable cage about the cage axis, a plurality of tool carrying members having a longitudinal axis and mounted within the rotatable cage for slidable movement along the longitudinal axis thereof between a rest position within the cage and an extended position whereby the tool carried by the tool carrying member projects from the cage into the path of the metal wire, selection means for selectively actuating a selected one of the plurality of tool carrying members and moving that selected one of the plurality of tool carrying members from its rest position to its extended position, and tool carrying member rotation means for rotating the selected one of the tool carrying members about its longitudinal axis. Preferably, the motor means includes gear means for rotating the rotatable cage.

In accordance with a preferred embodiment of the apparatus of the present invention, the apparatus includes channel means incorporated in the cage means and adapted for guiding the slidable movement of a selected one of the plurality of tool carrying members.

In accordance with another embodiment of the apparatus of the present invention, the plurality of tool carrying members each includes groove means at a location distal from the tool mounted thereon, and including ring means operatively associated with the plurality of groove means for mounting the plurality of tool carrying members within the cage.

In accordance with a preferred embodiment of the apparatus of the present invention, the apparatus includes a cylindrical housing and the rotatable cage is mounted within the crylindrical housing. Preferably the selection means includes jackscrew means mounted on the cylindrical housing, the jackscrew means including an actuatable rod for causing the selected one of the plurality of tool carrying members to slidably move from its rest position to its extended position, the cylindrical housing including an aperture, whereby the actuatable rod can move through the aperture to cause the slidable movement of the selected one of the plurality of tool carrying members.

According to a preferred embodiment of the apparatus of the present invention, ring means are provided and include a cut-out portion at a location corresponding to the groove means of the selected one of the plurality of tool carrying members.

The bending head which is the object of the present invention is integrally joined to the extremity of an arm which is mounted on the body of a machine for bending metal wire, and which pivots about a longitudinal axis which is the same as the axis of passage of the wire.

The bending head in accordance with the present invention consists of a cylindrical housing within which can rotate, about an axis which is perpendicular to the axis of passage of the wire, under the action of a first geared motor which is integrally joined to the arm, a cylindrical cage at the periphery of which are located, at equidistant positions, shafts (also referred to herein as "tool carrying members") whose axes are parallel to the axis of rotation of the cage. Each of these shafts is mounted in such a way as to be able to be slidably displaced within the cage along the length of the longitudinal axis of the cage, and also to pivot about that longitudinal axis, under the action of a second geared motor which is located outside the housing containing the cage, and whose leading shaft passes through the cage along the axis of rotation of the cage. Each of these shafts has at one of its extremities, i.e., at the extremity which is flush against the edge of the housing on the side of the housing at which the wire passes, a tool consisting of a finger and a bending unit.

On the housing and at its extremity opposite that of the point of attachment of the housing to the arm a jackscrew is affixed whose longitudinal axis is parallel to the axis of rotation of the cage, on the side thereof opposite the side at which the wire passes through, with the shank of the jackscrew being able to pass through an aperture in the housing in such a way as to cause the facing shaft to slide, thereby causing the tool which is fitted to the extremity of the shaft to emerge from the plane of the housing, at the level where the wire passes.

In this manner, when a desired length of the wire to be processed is led along the arm to the bending head, the first geared motor causes the cage to rotate in such a way as to position the peripheral shaft carrying the tool which is to be placed in operation facing the jackscrew. The shank of the jackscrew can then slidably displace the shaft, whose tool emerges at the level of the wire. The second geared motor then causes the shaft carrying that tool to pivot at the desired angle, thereby accomplishing the appropriate bending of said wire. The jackscrew then withdraws, thereby also withdrawing the shaft carrying that tool, the wire is moved forward, and the operation begins again with the same tool, or with another tool.

The bending head in accordance with the present invention advantageously therefore makes it possible, on the one hand, to have several tools available for a single given bending machine, and, on the other hand, when the arm is in a given positions, by acting on the rotation of the shaft carrying a particular tool, to bend the wire in a given direction, or in a diametrically opposite direction, thereby avoiding the need to cause the arm to rotate 180°. Furthermore, in the case of wires having different diameters, the bending head in accordance with the present invention now makes it possible for the wire to always remain tangent to the finger of said tool. a digital calculator records the movements of the machine, thereby providing proper positioning of the tool.

BRIEF DESCRIPTION OF THE FIGURE

The advantages and characteristics of the present invention can be more clearly understood and appreciated by means of the detailed description which follows, and which refers specifically to the attached FIGURE, which represents a nonlimiting embodiment of the present invention.

The FIGURE is a side, elevational, partial, sectional view of a bending head in accordance with the present invention.

DETAILED DESCRIPTION

Referring to the FIGURE, it can initially be seen that at the extremity of the arm 5, a bending head in accordance with the present invention includes a cylindrical housing 1 within which a cage 2 can rotate under the action of a geared motor 22 by means of toothed wheels 20 and 21, which are respectively integrally joined to the cage 2 and to the shaft 221 of the geared motor 22.

Cage 2 includes at its periphery shafts, two of which shafts 3 and 4 are shown in the FIGURE, and whose longitudinal axes are parallel to the axis of rotation Y—Y′ of the cage 2 and perpendicular to the axis of passage X—X′ of the wire. Shafts 3 and 4 can slide longitudinally within the cage 2 in channels 213 and 24, respectively.

Shafts 3 and 4 include, at their extremities opposite the extremity which carries the tool, peripheral grooves 33 and 43, respectively, within which passes the internal circumference of a ring 16 which is integrally joined to the housing 1. On the side of the housing 1 opposite that of arm 5 is affixed a jackscrew 13 whose axis is parallel to the axis Y—Y′, and whose rod 14 can pass through the housing 1 by means of a port 15 in such a way as to be able to cause the facing shaft, for instance the shaft designated in the FIGURE as 4, to slide within channel 24 of cage 2. For this purpose, the ring 16 includes a removable cut-out portion 17 which is integrally attached to the extremity of rod 14 of jackscrew 13.

Housing 1 and cage 2 are traversed centrally along the length of axis Y—Y′ by the leading shaft 11 of a geared motor 10, the leading shaft 11 including a toothed wheel 12 which can draw into rotation peripheral shafts 3 and 4 by means of toothed wheels 30 and 40, respectively, with which said shafts 3 and 4 are fitted.

Thus, the geared motor 22 draws cage 2 into rotation in such a way as to select the shaft and thus the tool 31 or 41 which is necessary for the operation which is to be performed on the wire, with the shaft being positioned facing the jackscrew 13. At this point, the cut-out portion 17 of ring 16 which is integrally joined to rod 14 of jackscrew 13 is positioned within the peripheral groove 33 or 43 of the particular shaft in question, and under the action of jackscrew 13 that shaft slides, and the tool located at the extremity of that shaft 3 or 4 then emerges from the housing 1 and finds itself oriented along axis X—X′. Geared motor 10 then rotates to the extent of the desired angle in such a way as to impart the desired curvature to the wire, which is being held within the tool. If the next bending operation requires another tool, jackscrew 13 then returns the shaft, and geared motor 22 selects that other tool.

In the event that two consecutive bending operations which are to be performed with the same tool are essentially diametrically opposite, then rather than causing the arm to rotate, the particular shaft carrying that tool is withdrawn into the cage, and the geared motor 10 causes that shaft to perform a half-rotation, whereupon the shaft is drawn out of said cage in such a way as to present that tool symmetrically with regard to its previous position, in order to perform the required bending operation.

In the case of wires having different diameters, it is sufficient to input into a digital calculator the diameter of the wire which is to be processed, whereupon the carrier shaft of that tool will position itself, by means of the housing, in such a way that the wire will now be tangent to the finger of that tool, with this operation being performed without any need for recourse to any other means of repositioning the finger. This procedure makes this entire operation noticeably simpler than those operations which must be performed with existing machines in order to achieve such results.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. Apparatus for bending metal wires passing along a predetermined axis on a longitudinally extending arm, said apparatus comprising a bending head affixed to said longitudinally extending arm, said bending head including a housing, a rotatable cage arranged within said housing and mounted on said arm and rotatable about a cage axis perpendicular to said predetermined axis, motor means for rotating said rotatable cage about said cage axis, a plurality of tool carrying members, each tool carrying member having a wire bending tool rotatable about said cage axis so as to bend said wire, each tool carrying member having a longitudinal axis and mounted within said rotatable cage for slidable movement along said longitudinal axis between a rest inoperative position within said cage and an extended operative position whereby at least one wire bending tool carried by said tool carrying member projects from said cage into the path of said metal wire, selection means for selectively actuating a selected one of said plurality of tool carrying members and moving said selected one of said plurality of tool carrying members from said rest position to said extended position, ring means arranged within said housing for supporting said plurality of tool carrying members and for providing a guide path therefor, and tool carrying member rotation means for rotating said selected one of said tool carrying members along said guide path defined by said ring means about said cage axis.

2. The apparatus of claim 1 wherein said motor means includes gear means for rotating said rotatable cage.

3. The apparatus of claim 1 including a channel means incorporated in said cage means, said channel means adapted for guiding said slidable movement of said selected one of said plurality of tool carrying members.

4. The apparatus of claim 1 wherein said plurality of tool carrying members each includes groove means at a location distal from said tool mounted thereon, said groove means being mounted on said ring means and being operatively associated therewith to permit said rotation of said tool carrying members.

5. The apparatus of claim 1 including a cylindrical housing, said rotatable cage being mounted within said cylindrical housing.

6. The apparatus of claim 5 wherein said selection means comprises jackscrew means mounted on said cylindrical housing, said jackscrew means including an actuatable rod for causing said selected one of said plurality of tool carrying members to slidably move from said rest position to said extended position, said cylindrical housing including an aperture, whereby said actuatable rod can move through said aperture to cause said slidable movement of said selected one of said plurality of tool carrying members.

7. The apparatus of claim 4 wherein said ring means includes a cut-out portion at a location corresponding to said groove means of said selected one of said plurality of tool carrying members.

8. The apparatus of claim 7 including a cylindrical housing, said rotatable cage being mounted within said cylindrical housing.

9. The apparatus of claim 8 wherein said selection means comprises jackscrew means mounted on said cylindrical housing, said jackscrew means including an actuatable rod affixed to said cut-out portion of said ring means for slidably moving said selected one of said plurality of tool carrying members.

* * * * *

UNITED STATES PATENT AND TRADEMARK OFFICE

CERTIFICATE OF CORRECTION

PATENT NO. : 5,349,838

DATED : September 27, 1994

INVENTOR(S) : Latour

It is certified that error appears in the above-identified patent and that said Letters Patent is hereby corrected as shown below:

Column 3, line 45, "221" should read --22'--.
Column 3, line 51, "213" should read --23--.

Signed and Sealed this

Thirteenth Day of December, 1994

*Attest:*

Bruce Lehman

BRUCE LEHMAN

*Attesting Officer*

*Commissioner of Patents and Trademarks*